United States Patent [19]

Cockle

[11] 3,934,630

[45] Jan. 27, 1976

[54] METHOD AND APPARATUS FOR PRODUCING ROUGH CUT LUMBER

[76] Inventor: Roy R. Cockle, P.O. Box 323, Roy, Wash. 98580

[22] Filed: Jan. 9, 1975

[21] Appl. No.: 539,930

Related U.S. Application Data

[63] Continuation of Ser. No. 351,199, April 16, 1973.

[52] U.S. Cl. ..... 144/39; 144/3 R; 144/1 R; 144/312

[51] Int. Cl.[2] .... B27M 1/00; B27B 1/00; B27C 1/08

[58] Field of Search ..... 144/1 R, 3 R, 37, 39, 41, 144/162 R, 172, 312, 326 R, 117 R

[56] References Cited

UNITED STATES PATENTS

| | | | |
|---|---|---|---|
| 462,797 | 11/1891 | Hazard | 144/39 |
| 3,442,310 | 5/1969 | Mitten et al. | 144/312 |
| 3,487,866 | 1/1970 | Mitten | 144/312 |
| 3,627,005 | 12/1971 | Morton | 144/39 |
| 3,692,074 | 9/1972 | Nilsson | 144/39 |
| 3,738,404 | 6/1973 | Walker | 144/39 |

*Primary Examiner*—Donald R. Schran
*Attorney, Agent, or Firm*—Cole & Jensen

[57] ABSTRACT

A method for producing rough cut lumber from small diameter poles of varying size at the pole harvest site including the steps of removing the bark from the pole, cutting longitudinal notches spaced around the periphery of the pole aligning and supporting the pole on rails disposed in these notches, shaping the pole with rotary cutting heads to form a rectangular beam while additionally supporting the pole by means of guides associated with each of the cutterheads.

Portable apparatus for producing rough cut lumber from a small diameter wood pole at the harvest site including rotary debarking knives, kerf cutting saws, support rails adapted to run in kerfs spaced around the periphery of the pole, cutterheads adapted to form the pole into rough cut lumber of rectangular cross section, each cutterhead having a planar support associated therewith. All of said wood forming tools and supports mounted on a frame and aligned along the path of travel of the pole to be processed through the apparatus, and all of said tools and supports, as well as the pole conveying means being simultaneously adjustable to process poles of varying diameter.

13 Claims, 18 Drawing Figures

INVENTOR.
ROY R. COCKLE

BY Brayton, Cole & Barnard

ATTORNEYS

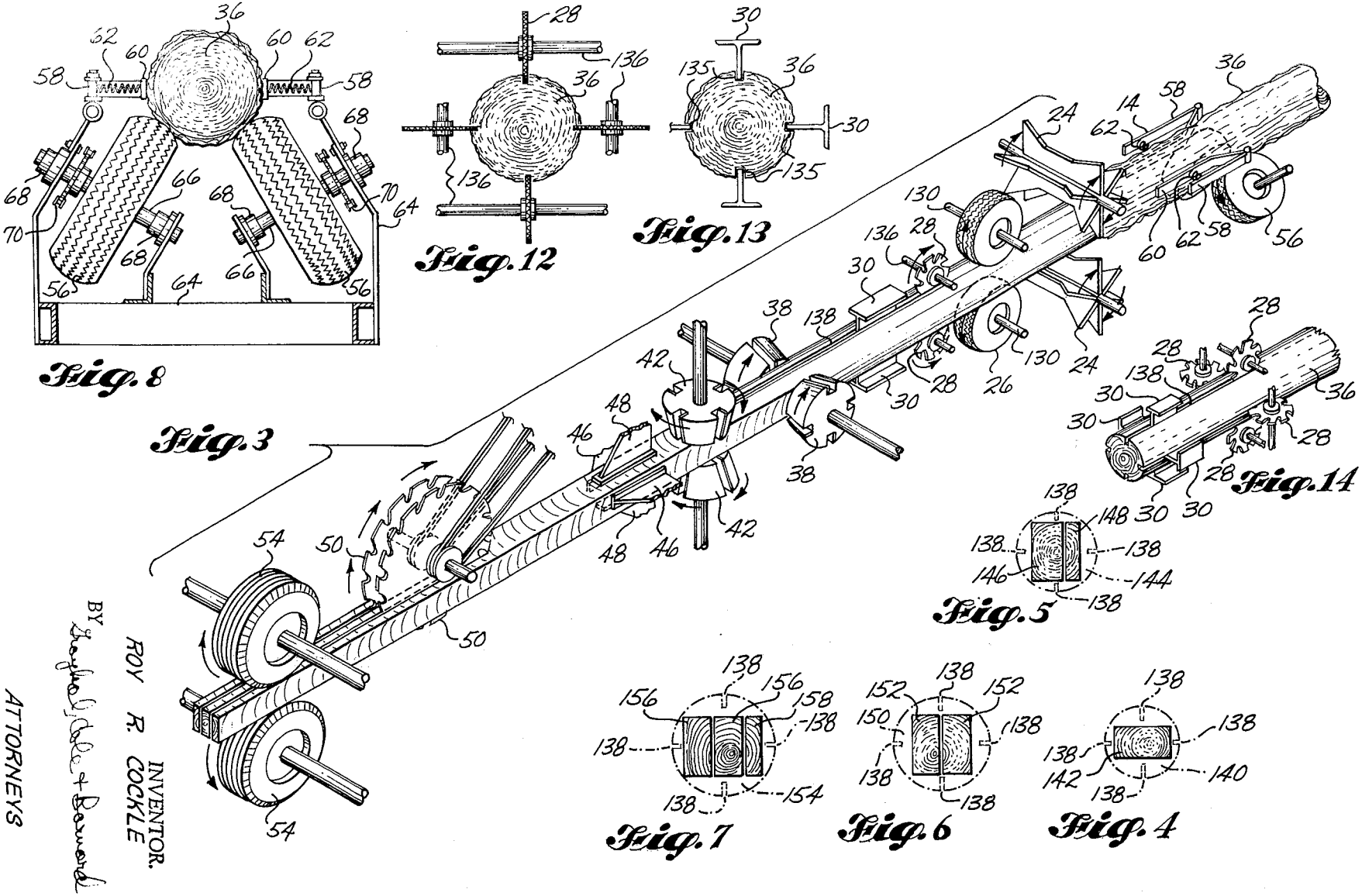
INVENTOR.
ROY R. COCKLE
BY Graybeal, Cole & Barnard
ATTORNEYS

INVENTOR.
ROY R. COCKLE

BY Stopfel, Sohl & Barnard

ATTORNEYS

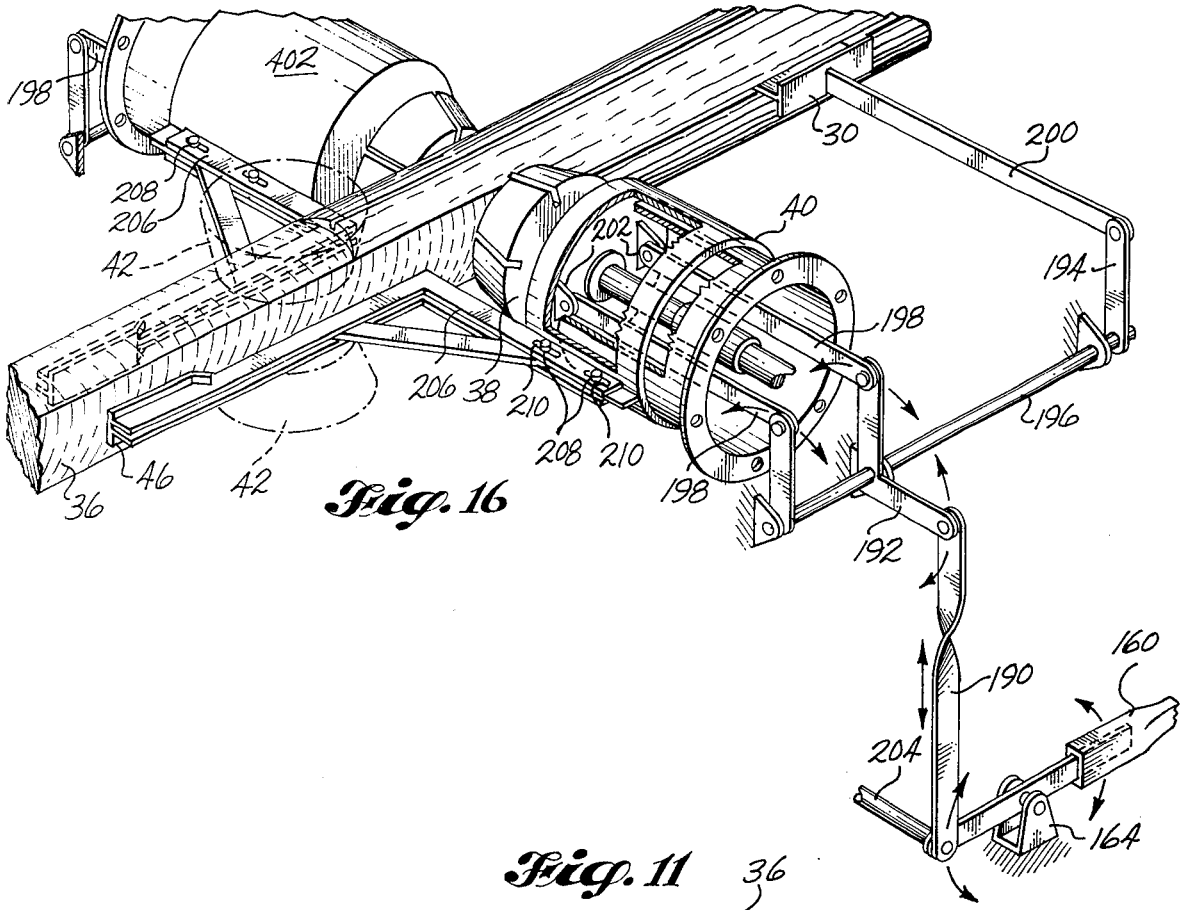
Fig. 16
Fig. 11
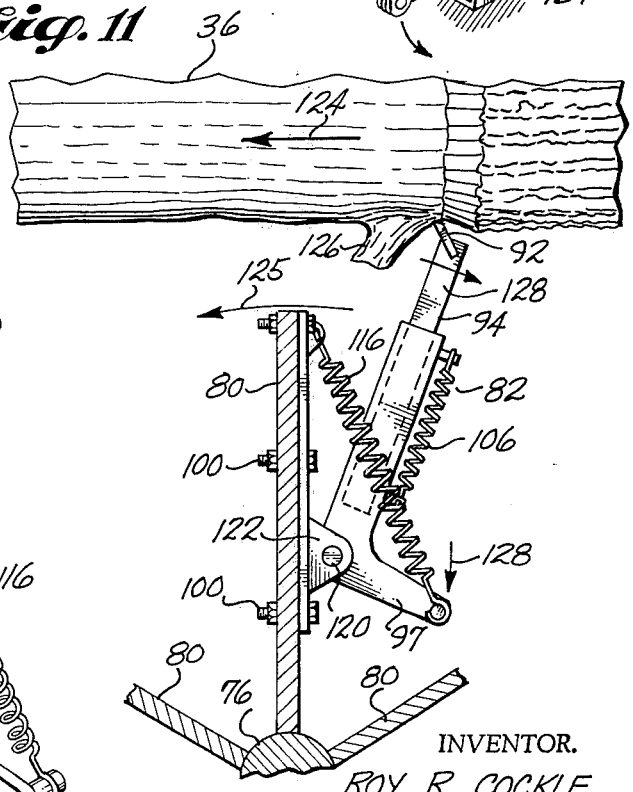
Fig. 10
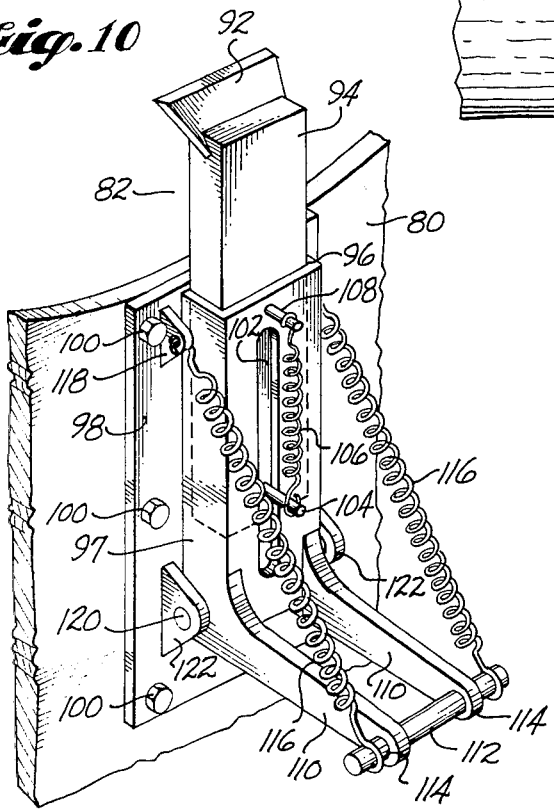
INVENTOR.
ROY R. COCKLE
BY
Graybeal, Colton & Barnard
ATTORNEYS

INVENTOR.
ROY R. COCKLE
BY
ATTORNEYS

INVENTOR.
ROY R. COCKLE
BY Graybeal, Cole & Barnard
ATTORNEYS

INVENTOR.
ROY R. COCKLE

BY [illegible] + Barnard

ATTORNEYS

METHOD AND APPARATUS FOR PRODUCING ROUGH CUT LUMBER

This is a continuation of application Ser. No. 351,199, filed Apr. 16, 1973.

BACKGROUND OF THE INVENTION

1. Field of the Invention

This invention relates, in general, to a method and apparatus for producing rough cut lumber from small diameter wood poles, and in particular, to a method and apparatus for conveying, aligning and holding a pole while it is shaped to form a rectangular beam, and optionally ripping the beam to form rough cut lumber, the disclosed apparatus being easily adjustable for processing poles of varying diameter.

2. Description of the Prior Art

It is well known that there exists in many areas of semi-arid climate, large stands of mature timber having trunks averaging less than 10 inches in diameter. At present, it is usually uneconomic to harvest trees of this size, and after reaching maximum growth, they are inevitably wasted by insect infestation or clear cut and burned. In other more climatically hospitable forested areas, the technique of thinning small diameter trees from a forest of larger trees to reduce the growth competition and stimulate the development of the larger more valuable trees is often practiced. In the past, these small diameter trees have often been cut and left to rot on the forest floor or transported to a central point and burned to clear the forest floor. In the above situations, the small diameter trees have usually not been harvested because the cost of cutting, transporting the raw timber to a sawmill and processing it into lumber has been greater than the market value of the relatively small amount of usable lumber which may be cut therefrom.

Apparatus for processing small diameter logs into lumber and pulp chips for use in the paper industry is known. Apparatus of this type is disclosed in Runnion, Pat. No. 3,259,157 and in Mitten Patents, Nos. 3,313,329; 3,344,826; 3,346,028; 3,442,310; 3,454,063 and 3,487,866.

The Runnion patent relates to large, stationary equipment which chips a previously debarked log into a cross sectionally stepped configuration before sawing it into lumber. Chains are employed above and below the log to both convey it and hold it during chipping.

Mitten, Pat. No. 3,313,329 discloses apparatus substantially different from that disclosed herein limited to the processing of logs having diameters of between 5 inches and 8 inches to form either 4 × 4 inch or 4 × 6 inch cants.

Mitten, Pat. No. 3,344,826 relates to large, stationary apparatus limited to producing 4 × 4 inch cants from peeler cores between 5½ and 6 inches in diameter, and cannot be adjusted to handle logs of varying size.

Mitten, Pat. No. 3,346,028 relates to the profiling of a log with a cutterhead to produce an improved pulp chip and is concerned primarily with the shape of the pulp chip a consideration of no significance to the instant invention.

Mitten et al., Pat. No. 3,442,310 relates to apparatus for profiling only the bottom and sides of a log, and additionally discloses cutting shallow reentrant reference points on the bottom flat which act as guides in correlating the log to the side cutters.

Mitten, Pat. No. 3,454,063 discloses the use of V-shaped cutterheads to form meeting flats on diametrically opposed sides of a log. No means are disclosed for removing the bark from the log or for holding the log prior to cutting, while V-grooved guides support the log after it has been shaped. Again, as with all the Mitten patents, wood pulp chips are produced from the chordal segments cut away to shape the cant.

Mitten, Pat. No. 3,487,866 discloses holding a log while it is shaped to form a rectangular cant by means of two spaced support grooves cut only in the bottom of the log. A channel shaped shoe is provided to mate with the support grooves, and a chain disposed in said channel is adapted to convey the log past the chip forming cutters. No means for debarking the log is disclosed, nor is any means for adjusting the apparatus to process logs of varying sizes disclosed. The method of supporting a log during shaping disclosed by this patent may be effective with logs of relatively large diameter, such as the 12 inch log discussed therein, in that the support grooves may be cut to a significant depth without entering the later formed cant. In logs of smaller diameter, however, the possible depth of these grooves is limited thereby providing insufficient purchase for the channel shaped shoe to hold the log stable during shaping.

BRIEF SUMMARY OF THE INVENTION

The present invention provides an improved method and apparatus for producing rough cut lumber from wood poles ranging in diameter from approximately 3 inches to approximately 10 inches. The apparatus of the present invention is lightweight and compact compared to those previously known, and is adapted to be mounted on wheels such that it may be transported to the harvest site of the small diameter raw lumber. Producing rough cut lumber at the harvest site significantly reduces transportation costs to a finishing mill in that the waste material cut from the raw timbers in shaping rough cut lumber may be left in the forest. Along this line, the apparatus of the present invention includes cutterheads adapted to reduce the waste material to sawdust rather than slabs or chips. This waste sawdust may be easily spread on the forest floor where it will naturally decompose in a relatively short time, thus eliminating the need for burning the waste and the consequent air pollution.

The apparatus of the present invention is adapted to debark a pole, shape it to form a rectangular cant and cut the cant into rough cut stud lumber in a single pass therethrough. In processing logs having diameters of less than five inches the rough cut lumber may be formed immediately and the final cutting omitted. Unique means for holding the debarked log while it is shaped, comprising cutting longitudinal kerfs spaced at intervals around the periphery of the pole and disposing stationary metal rails in these kerfs is also provided.

The entire pole holding, conveying and shaping system is adjustably mounted on a frame adjacent the linear path of travel of a pole to be processed and is simultaneously manually adjustable for processing logs of varying diameters. The pole shaping cutterheads include adjustable cylindrical mounts having planar beam supports integrally connected thereto to additionally support the cant while it is being shaped.

It is an object of the present invention, therefore, to provide a method and apparatus for producing rough cut lumber from a small diameter wood pole.

Another object of the present invention is to provide portable, compact apparatus for producing rough cut lumber from a wood pole at the wood pole harvest site.

Still another object of the present invention is to provide apparatus for producing rough cut lumber from a raw, barked pole in a single pass therethrough.

An additional object is to provide apparatus which is adjustable for producing rough cut lumber from wood poles of varying diameter.

One more object is to provide an apparatus for supporting the wood pole while it is shaped to form a piece of rough cut lumber having a rectangular cross section.

Another object is to provide pole forming apparatus adapted to reduce all waste material to relatively rapidly decomposable sawdust.

Other and additional objects and advantages will be apparent from the following description taken in conjunction with the accompanying drawings.

BRIEF DESCRIPTION OF THE DRAWINGS

FIG. 3 is a partial diagrammatic perspective view of the linearly aligned elements of the present invention, including a wood pole longitudinally processed from the raw wood stage to rough cut stud lumber.

FIG. 4 is a sectional end view of a 2 × 4 piece of rough cut lumber produced according to the present invention, including in dotted line, the kerfed pole from which it was produced.

FIG. 5 is a sectional end view of a 2 × 4 piece and a 1 × 4 piece of rough cut lumber, including in dotted line, the kerfed pole from which these pieces were produced.

FIG. 6 is a sectional end view of a pair of 2 × 4 pieces of rough cut lumber, including in dotted line, the kerfed pole from which they were produced.

FIG. 7 is a sectional end view of two 2 × 4 pieces and one 1 × 4 piece of rough cut lumber, including in dotted line, the kerfed pole from which they were produced.

FIG. 8 is a sectional elevation view of the loading platform of the present invention, including angularly disposed rollers supporting a pole, and horizontal aligning means mounted thereon for said pole.

FIG. 10 is a partial perspective view of a typical spring loaded debarker knife made according to the present invention.

FIG. 11 is a side elevation view of the debarker knife of FIG. 10, including a pole and the debarker knife pivoted in response to its striking a stub limb on said pole.

FIG. 12 is a sectional elevation view of the kerf cutting saws of the present invention positioned about the periphery of a wood pole, including in dotted line the shape of the rough cut lumber to be produced therefrom.

FIG. 13 is a sectional elevation view of the guide rails of the present invention disposed in the kerfs cut on said wood pole.

FIG. 14 is a partial perspective view of the kerf cutting saws and associated guide rails of the present invention.

FIG. 16 is a partial perspective view of the side cutterheads of the present invention, including the cutterhead adjustment means and integrally mounted planar support associated with one of said cutters.

DETAILED DESCRIPTION OF THE INVENTION

Figure 1:
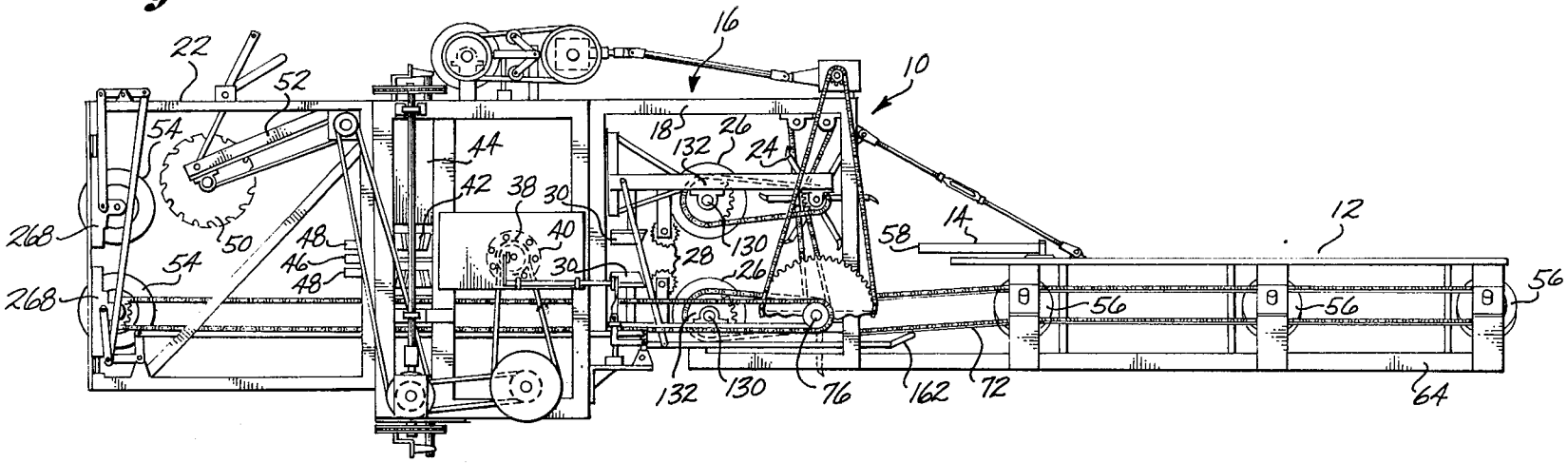
FIG. 1 is a partial side elevation view of a typical apparatus made according to the present invention.

Referring now to the drawings, and particularly to FIG. 1, an apparatus 10 for producing rough cut lumber from a raw wood pole is disclosed. Apparatus 10 includes, in general, pole loading platform 12 having horizontal pole positioning braces 14 mounted thereon. Platform 12 is mounted linearly adjacent support frame 16, which for discussion purposes will be arbitrarily divided into infeed section 18, central log shaping section 20 and outfeed section 22.

Figure 2:
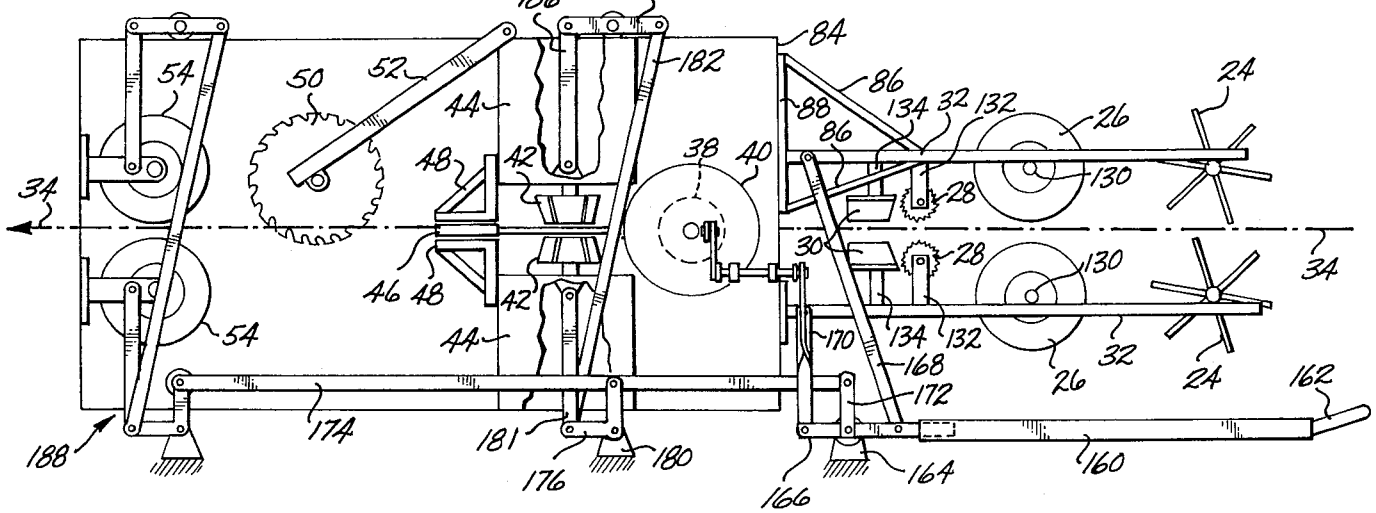
FIG. 2 is a schematic view of the pole diameter adjustment means of the apparatus of FIG. 1.

Referring also to FIG. 2, it will be seen that infeed section 18 includes rotary debarker means 24, pole drive wheel 26, kerf cutting saws 28 and guide rails 30. As will be described more completely hereafter, the debarking means, drive rollers, and the kerf cutters and support rails comprise pairs of substantially identical members mounted on movable support beams 32 such that the distance of these members from the linear path of travel of a pole through the apparatus 10, illustrated as dashed arrow 34, may be varied. Referring to FIGS. 12, 13 and 14 it will be understood that kerf cutters 28 and support rails 30 may be mounted on the sides as well as the top and bottom of pole 36, for example, and that the side cutters and rails have not been illustrated in FIGS. 1, 2 and 3 for purposes of drawing clarity only.

Pole shaping section 20 of the apparatus 10 includes side cutterheads 38 mounted on cylindrical drum supports 40 and vertical cutterheads 42 mounted on cylindrical drum supports 44. Planar beam supports 46 are mounted on side cylindrical cutterhead supports 40, while planar beam supports 48 are mounted on vertical cylindrical cutterhead supports 44. Again, as will be described more completely hereafter, cutterheads 38 and 42, and integrally connected planar supports 46 and 48 are adjustable with respect to the linear path of travel 34 of the pole to be processed.

Referring now to outfeed section 22 of the apparatus 10, rotary ripping saws 50 are mounted on pivotal supports 52 such that either or both saws may be moved in or out of contact with a beam traveling on linear path 34. Finally, vertically adjustable outfeed rollers 54 are provided to convey the rough cut lumber from the apparatus. Although not shown on the drawings, it will be understood that a variety of conventional apparatus such as rollers, conveyor belts, or slides may be mounted adjacent the outfeed end of apparatus 10 to carry the rough cut lumber to a storage point or directly to a truck to convey it to a mill for drying and finish planing.

Referring again to FIG. 1, it will be understood that all of the elements of apparatus 10 are adapted to be driven through the illustrated conventional chain of axles, wheels, belts, chains and sprockets from a single power source such as the power takeoff of a tractor. For the most part, this drive system is considered to be old and conventional and will not be described in detail except for particular elements set forth hereafter, it being considered that the accompanying drawings amply illustrate this drive system. It should nevertheless be understood that the drive system is important in that for proper operation the speeds at which the various members such as the debarking means 24 or cutterheads 38 or 42 are driven must be properly related to the speed at which drive rollers 26 and 54 convey a pole therethrough. For instance, it has been found that the debarker knives which rotate in the same direction as the movement of the pole therethrough should be rotated at a speed at least four times greater than the speed of travel of the pole. With regard to kerf cutting saws 28, rotary heads 38 and rip saws 50, it is only necessary that these be driven at conventionally high speeds so that they may properly cut or shape the wood pole passed therethrough.

Referring now to FIG. 3, wherein the processing of a raw wood pole to rough cut lumber by the apparatus of the present invention is schematically illustrated, it will be seen that a recently cut and debranched pole 36, having a diameter of between 3 inches and 10 inches, is first mounted on the loading platform which includes feed rollers 56 the top portions of which are angled inwardly to support pole 36. Poles 36 may be of any length, but commonly are pre-cut to 8 foot lengths. The pole is then centered with respect to a desired linear path of travel through the apparatus by means of centering braces or guides 14 which include fixed outer arms 58 and flexible inner arms 60 which are biased inwardly by compression springs 62 mounted between arms 58 and 60. Referring also to FIGS. 1 and 8, the construction of one embodiment of the loading platform and spring loaded centering guides is more completely disclosed. Three sets of inwardly toed feed rollers 56 are mounted at intervals along longitudinal frame 64. Feed rollers 56 are conventionally mounted on angularly disposed axles 66 which, in turn, are mounted by means of rotatable bearings 68 to support frame 64. Axles 66 include sprockets 70 through which the feed rollers are driven by cooperating chain 72 which extends from a sprocket 74 (FIG. 9) mounted on driving axle 76. It will be readily understood that while guide means 14 are provided to center the pole horizontally with respect to the desired path of travel through the apparatus, the vertical positioning of the log is fixed by feed rollers 56 upon which the pole rides.

Figure 9:
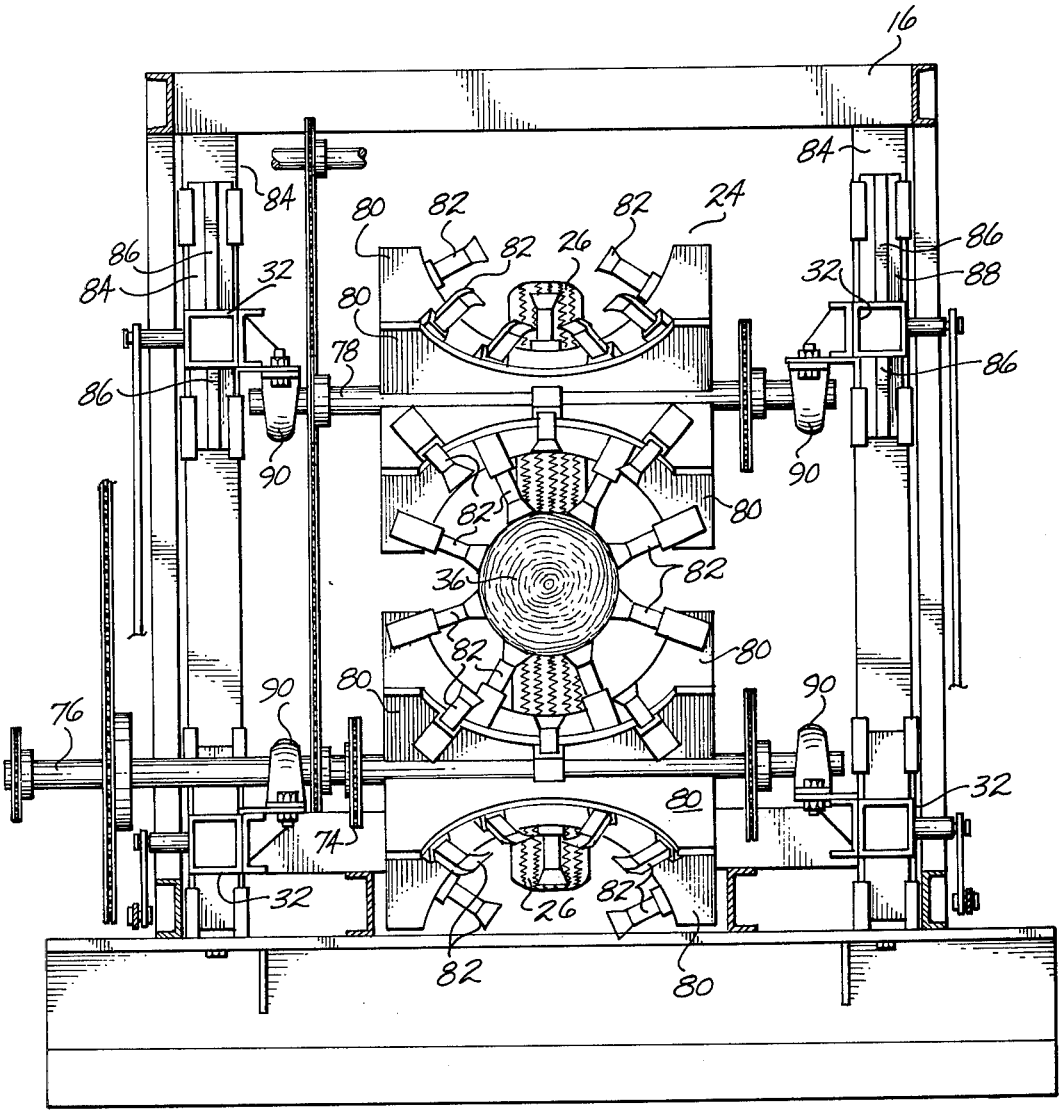
FIG. 9 is a sectional elevation view of the debarking apparatus of the present invention.

Referring again to FIG. 3, it will be seen that in the disclosed embodiment, the log is conveyed longitudinally, large end or small end first, into the debarker 24. Referring specifically to FIG. 9, it will be seen that debarkers 24 include a lower shaft 76 and an upper shaft 78 on which outwardly extending ribs 80 are fixedly mounted. Shafts 76 and 80 are positioned equal distances above and below the linear path of travel of the log therebetween. In the disclosed embodiment, shafts 76 and 80 each carry six equally spaced ribs, which ribs in turn alternately carry three or four spring loaded knives. As is best seen in FIG. 9, the knives are spaced on alternate ribs such that the knives on shaft 78 remove the bark from the top half of pole 36 while the knives on shaft 76 remove the bark from the lower half thereof.

As has been briefly described above with reference to FIG. 2, shafts 76 and 78 are mounted for rotation in bearings 90 on horizontal support beams 32 which are adapted to be adjusted vertically on parallel wall 84 extending between infeed section 18 and cutterhead shaping section 20 of support frame 16. As is best seen in FIG. 2, upper horizontal beams 32 include angular support braces 86 extending outwardly from plate 88 which is slidable with respect to wall 84.

Referring now to FIGS. 10 and 11, the construction and operation of a spring loaded debarker knife 82 is disclosed. Knife 82 includes cutting blade 92 mounted on rectangular support bar 94 which is adapted to slide in rectangular channel 96 of support 97 which is pivotally connected by means of pin 120 extending through fittings 122 to fixture 98. Fixture 98 is mounted by conventional nuts and bolts 100 to arcuate rib 80. Support 97 includes channel 102 through which pin 104, which extends outwardly from support bar 94, passes. Tensioning spring 106 extends between pin 104 and pin 108 which is aligned with slot 102. As will be readily understood from reference to FIG. 10, spring 106 biases support bar 94 vertically upward in channel 96.

Pivotal support 97 further includes outwardly extending arms 110 interconnected near their outer ends by bar 112 which extends through holes 114 in said arms. Springs 116 extend between bar 112 and fittings 118 mounted on fixture 98, and bias support 97 towards rib 80 as disclosed in FIG. 10.

In FIG. 11, the operation of the pivotally mounted spring loaded knife 82 is disclosed. Arrow 124 illustrates the path of travel of pole 36, while arrow 125 illustrates the direction of rotation or ribs 80. As set forth above, ribs 80 rotate such that knife blade 92 is moving at least four times faster than log 36 at the time the blade contacts the surface of the log. Rotating knife blade 92 strikes the surface of pole 36 and is scraped therealong to remove the bark therefrom. In normal operation, support bar 94 is forced downwardly into channel 96 as rib 80 approaches the vertical position illustrated in FIG. 11. Spring 106 acts to raise support bar 94 in channel 96 after rib 80 has rotated past the vertical position. When the pivotally mounted spring loaded knife 82 strikes a knot or the stub of a tree limb such as 126, spring loaded knife 82 is caused to pivot in the direction of arrows 128 about bar 120. After the rotation of rib 80 has carried knife 82 past stub 126, spring 116 which has been extended by the pivotal movement of support 97 acts to move the knife back to the substantially vertical position illustrated in FIG. 10.

Referring again to FIG. 3, it will be seen that after pole 36 has been debarked, drive rollers 26 act on the debarked pole to further convey it along linear path 34 through apparatus 10. As disclosed, the drive rollers comprise conventional small diameter rubber tires inflated to a low pressure such that they may be easily deformed if forced to roll over a tree limb stub for example. Tires 26 are inflated to equal pressures and thus act to center the pole with respect to the kerf cutters 28, thereby allowing either end of the pole which often vary in diameter to be put through the machine first. Other conventional roller means may be substituted for these tires, or pairs of equally inflated laterally adjacent tires may be mounted on axles 130 both above and below the pole 36 such that the pole will tend to ride in the slot between the laterally spaced tires thereby gaining a degree of lateral support. As is best seen in FIG. 1, axles 130 are mounted for rotation in bearings 132 which are in turn mounted on vertically adjustable horizontal support bars 32.

Referring again to FIG. 3, drive rollers 26 drive pole 36 through adjacent kerf cutting saws 28 disposed about the periphery of the pole. Referring to FIGS. 12–14, it will be seen that kerf cutting saws 28 may be mounted to cut four kerfs at intervals of 90° about the periphery of pole 36, although the invention is not limited to this configuration, and, for example, three kerf cutting saws spaced at intervals of 120° about the periphery of the pole or any other configuration adequate to support the pole during shaping by cutterheads 38 and 42 may also be used. As shown, cutters 28 cut kerfs on the top, bottom and opposed sides of the pole. Support rails 30 are provided immediately adjacent the kerf cutting saws and are adapted to ride in the newly formed kerfs to firmly support the log and prevent its twisting or turning during shaping by cutterheads 38 and 42. As is best shown in FIG. 2, the vertically disposed kerf cutting saws 28 and the vertically disposed support rails 30 are mounted on support shafts 132 and 134 which are in turn fixedly connected to vertically adjustable horizontal support bars 32. Although not disclosed in FIG. 2 to clarify the drawing, it will be readily understood that side kerf cutting saws 28 and side support rails 30 are mounted in a substantially similar manner and are also adapted to be horizontally adjusted for processing poles of varying diameter.

In one embodiment of the present invention, the kerf cutting saws are 8 inch diameter replaceable tooth saws having a thickness of three-eighths inch. The thickness of nose portion 135 of the following support rail is equal to or slightly less than the width of the continuous longitudinal kerf cut by saws 28 and therefore fits firmly therein. Saws 28 are mounted for rotation on axles 136 which are driven from the main power source through a conventional drive system.

The depth of the kerfs 138 varies depending on the diameter of the pole to be processed and the configuration of the rough cut lumber produced therefrom. The kerfs 134 should not be so deep as to cut into the rectangular cant formed by the cutterheads 38 and 42, but it has been found to be desirable to maintain the bottom portion of the kerf within one-fourth inch of the later formed cant to give guide rails 30 a firm bite therein.

FIGS. 4-7 illustrate examples of various configurations of pieces of rough cut lumber cut from raw wood poles of varying diameter. FIG. 4, for example, discloses in dotted line, a pole 140 having a diameter of less than five inches, from which a 2 × 4 stud 142 may be cut. FIG. 5 discloses a kerfed pole 144 having an unbarked diameter of at least 5 inches from which a 2 × 4 stud 146 and a 1 × 4 board 148 may be cut. FIG. 6 discloses a pole 150, approximately 6 inches in diameter from which two 2 × 4 studs 152 may be cut. Finally, FIG. 7 discloses a pole 154 having a diameter of at least 6½ inches from which two 2 × 4 studs 156 and one 1 × 4 board 158 may be cut. It will be readily understood that other combinations of various sized lumber may be cut from poles having diameters smaller or larger than those illustrated. For instance, two 2 × 6 beams and one 1 × 6 board may be cut from a pole having a debarked diameter of at least 7.8 inches.

Referring now to FIG. 2, the linkage system whereby horizontal support beams 32 which carry debarkers 24, feed rollers 26, kerfing saws 28 and support rails 30, is disclosed. Lever arm 160, including handle portion 162, is disposed subadjacent the infeed end of frame 16 and is pivotally mounted at a point spaced from end 166 of lever 160. Beam 168 extends from lever 162 to top horizontal support beams 32, while beam 170, which is mounted on end 166 of the lever arm is connected to lower horizontal support beams 32. It will be readily understood that the raising of handle 162 causes beam 168 to move top horizontal support beams 32 upwardly, while beam 170 pulls bottom support beams 32 downwardly. Bar 172 is fixedly connected at its lower end to lever 160 and is pivotally connected at its upper end to horizontal beam 174 which interconnects the vertically oriented cutterheads 42 and the outfeed rollers 54 such that these elements may be adjusted in vertical directions simultaneously with the movement of horizontal support beams 32.

Beam 174 is connected to one end of angular member 176, and is adapted to pivot it about support bracket 180. Angular member 176 is connected at its opposite end to beam 181 which is adapted to move lower vertical cutterhead 42 toward or away from the linear path of travel 34 of a pole through the disclosed apparatus, and to beam 182 which is additionally connected through pivotally mounted beam 184 to beam 186 which is adapted to move upper vertical cutterhead 42 in a direction equal to and opposite the movement of the lower cutterhead. In substantially the same manner, horizontal beam 174 is connected to linkage system 188 for movement of the outfeed rollers, and this linkage system will not be described in detail.

Referring additionally to FIG. 16, one means for adjusting side cutterheads 38 and side guide rails 30 is disclosed. As shown, lever arm 160 is also adapted to move twisted beam 190 in vertical directions. Beam 190 is connected at its upper end to angular brackets 192 and 194, the latter through extension bar 196. It will be readily understood that the vertical movement of beam 190 causes brackets 192 and 194 to move bars 198 and 200 toward or away from wood pole 36. Bars 198 are connected by conventional means 202 to cylindrical side cutterhead supports 40. Although not illustrated in the drawing, the cutterhead 38 and guide rail 30 on the opposite side of pole 36 may be adjusted through a similar linkage system connected to lever arm 160 through connecting rod 204. From all of the above, it will be understood that the entire apparatus, except for ripping saws 50, may be simultaneously adjusted by pivoting lever arm 160 to process logs of varying diameter.

In another embodiment of the present invention, separate linkage systems may be provided for separate adjustment of the vertical and horizontal cutters and supports. It should also be understood that none of the elements of the instant apparatus need be adjustable more than 4 inches in order to handle poles varying from 3 inches to 10 inches in diameter.

Referring again to FIG. 16, it will be seen that planar supports 46 are mounted on angular arms 206 which are connected at their opposite ends by conventional means 208 to cylindrical cutterhead supports 40. Slots 210 are provided such that arms 206 may be adjusted such that planar support 46 is aligned with the end cutting surface of cutterheads 38. Vertical planar supports 48 are mounted in like fashion on vertical cylindrical cutterhead supports 44.

Figure 15:
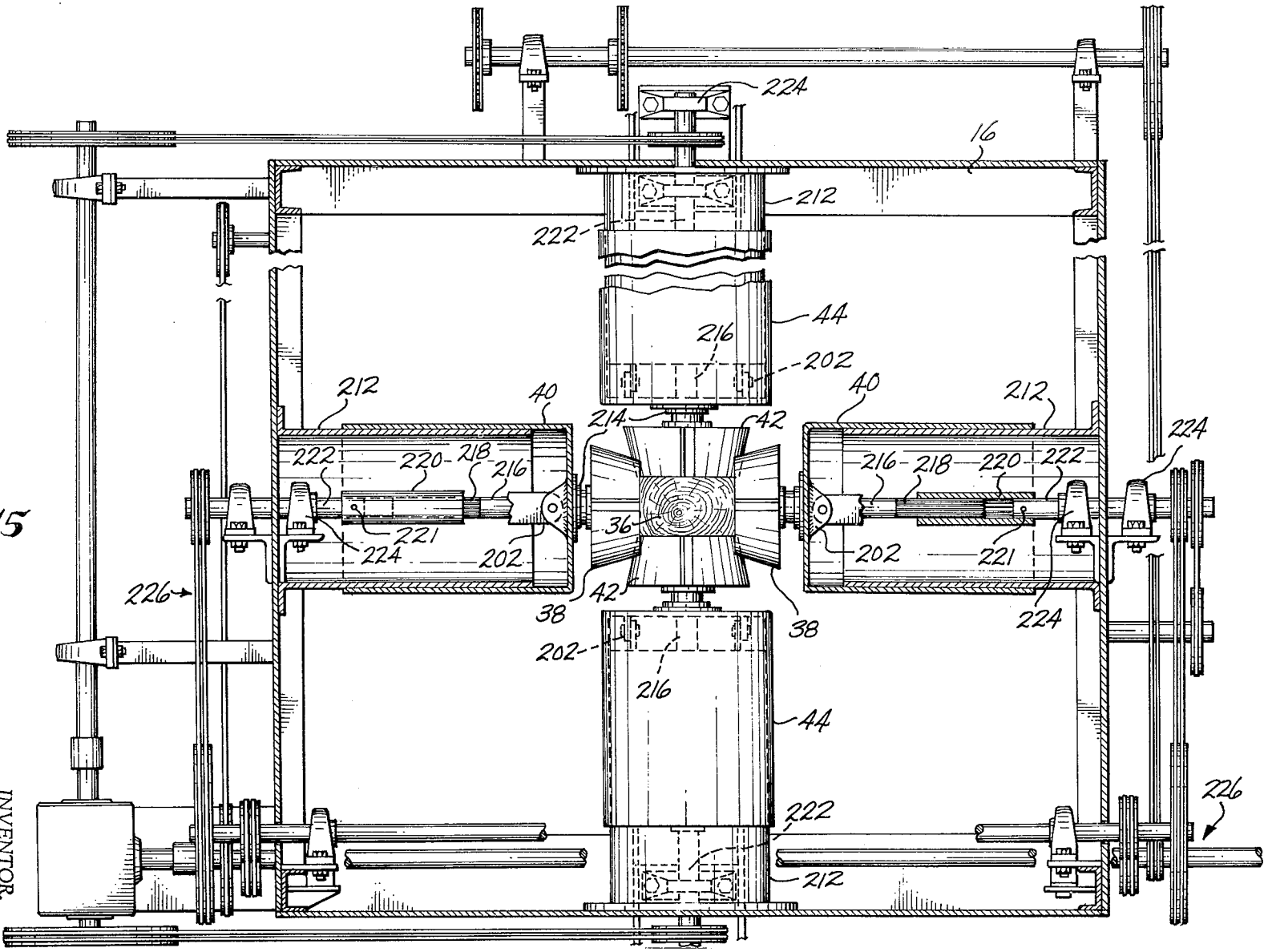
FIG. 15 is a sectional elevation view of the cutterheads and cutterhead support and drive means of the present invention.

Referring now to FIG. 15, the construction and orientation of the cutterheads of the instant invention is more completely disclosed. Cylindrical cutterhead supports 40 and 44 are slidably mounted on cylinders 212 which are fixedly mounted on support frame 16. Cylinders 212 have an outside diameter slightly smaller than the inside diameter of cylinders 40 and 44 such that the outer cylinders rotate freely thereover. The cutterheads are mounted on drive shafts 216 which rotate on bearings 214 disposed centrally in the ends of cylinders 40 and 44. Drive shafts 216 include splined end portions 218. Cylindrical collars 220 are fixedly mounted at one end by means of rivet or pin 221 to shafts 222 and include internal longitudinal grooves near their other end adapted to mate with the splines of drive shaft 216 to prevent relative rotation of shaft 216 and collar 220. The spline connection provides a system for positively driving the cutterheads while still allowing the cutterheads to be adjusted by longitudinally moving the shaft 216 within collar 220. As is further disclosed in FIG. 15, drive shafts 222 are conventionally mounted in bearings 224 to which rotational force is supplied through conventional drive belt system 226 from a single power source.

Figure 17:
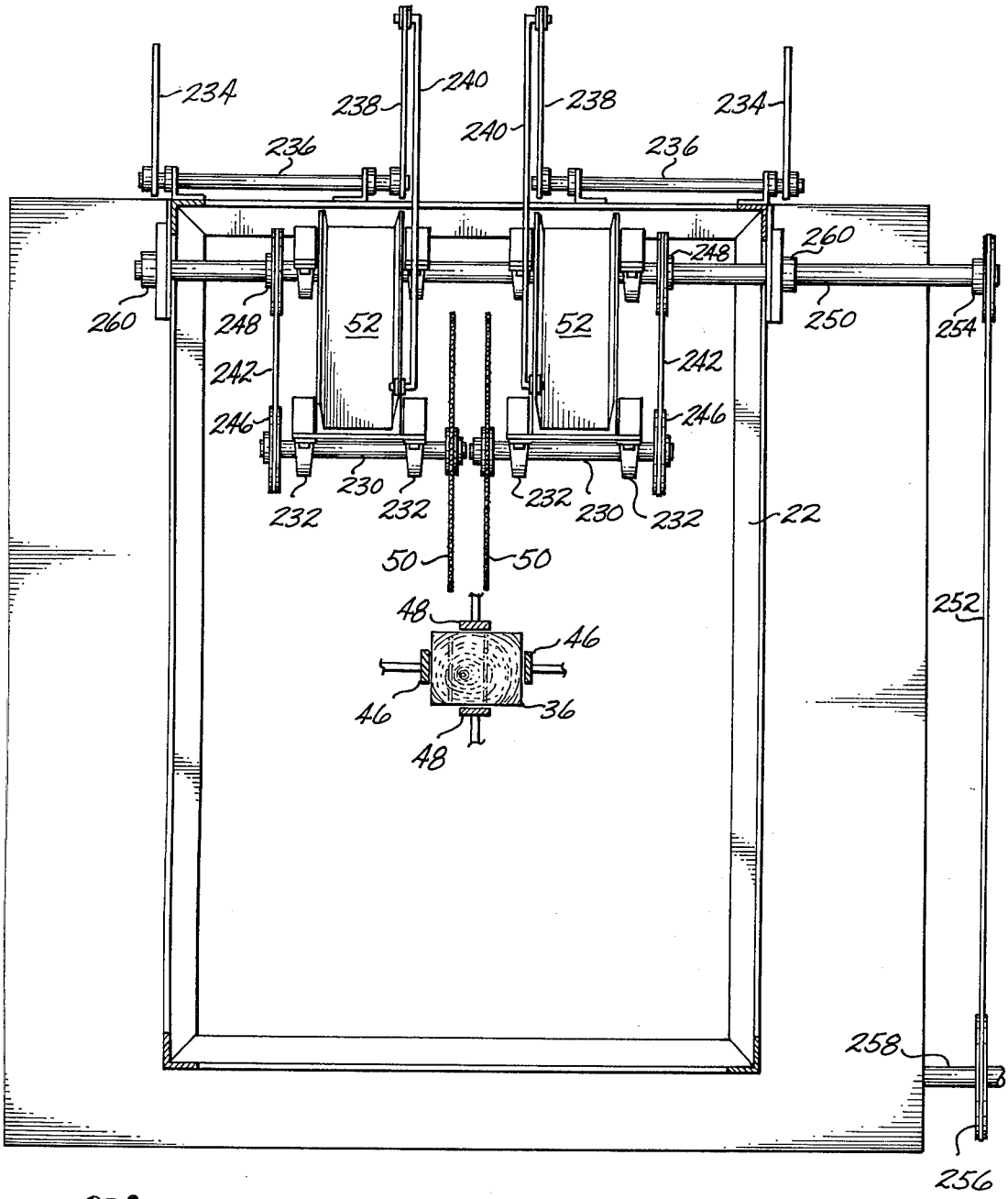
FIG. 17 is a sectional elevation view of the pivotally mounted rip saws and rip saw drive means of the present invention, including a rectangular cant and planar supports therefor.

Referring now to FIG. 17, the mounting and operation of rip saws 50 in outfeed section 22 of the apparatus is disclosed. Saws 50 are conventionally mounted on axles 230 which in turn are mounted for rotation in roller bearings 232 on pivotal arms 52. A positioning control system including handles 234, rotatably mounted rods 236, and linkage bars 238 and 240 are connected to pivotal arms 52 to allow the arms 52 to be independently pivoted in the vertical direction about their connection with frame 22 to alternatively cut or not cut wood cant 36 as it passes therebelow. As has been heretofore described with reference to FIGS. 4–7, either or both saws may be used depending upon the initial diameter of the pole to be processed and the desired configuration of the rough cut lumber. As disclosed in FIG. 17, saws 50 are conventionally driven through belts 242 which interconnect pulleys 246 and 248 mounted respectively on shafts 230 and 250, and belt 252 which interconnects pulleys 254 and 256 mounted respectively on shafts 250 and 258. Bearings 260 are mounted on frame section 22 to support shaft 250 and allow it to rotate with respect thereto.

Figure 18:
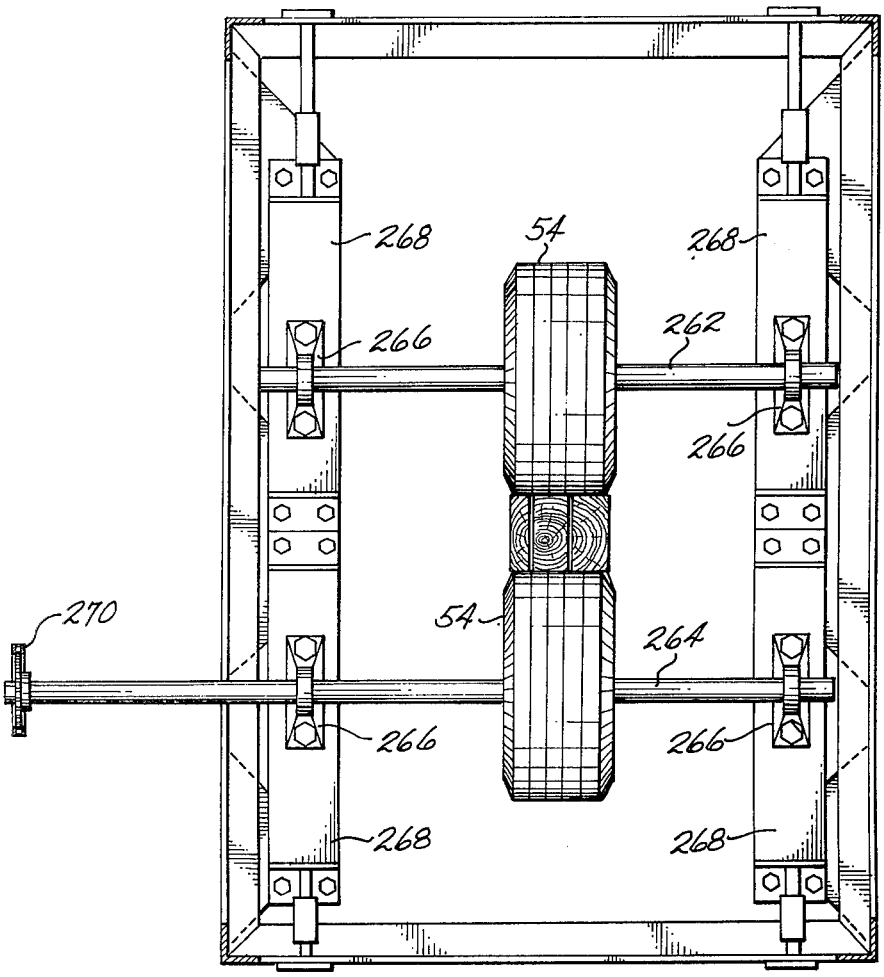
FIG. 18 is a sectional elevation view of the feedout rollers and feedout roller support means of the present invention.

Referring now to FIG. 18, upper and lower outfeed rollers 54 mounted respectively on support axles 262 and 264 are disclosed. Conventional bearings 266, which support axles 262 and 264, are mounted on vertically movable slides 268 such that outfeed rollers 54 may be adjusted for processing lumber of varying size as has been heretofore described. As disclosed, axle 264 is driven through pulley 270 mounted thereon which is interconnected to the drive system disclosed above. While axle 262 is a non-powered follower it should be understood that both of these axles may be power driven if desired.

From all of the above, it will be seen that the present invention discloses a method of producing rough cut lumber from a wood pole including the steps of placing the pole on a loading platform, centering the pole vertically and horizontally with respect to a linear path of travel through apparatus 10. Conveying the pole longitudinally along the path of travel consecutively past debarker knives which remove the bark therefrom, kerfing saws which notch longitudinal kerfs about the pole, and guide rails which ride in the newly formed kerfs to prevent the pole from twisting under the action of cutterheads which shape the pole to a rectangular cross section by cutting chordal segments from the periphery of the pole. After passing through the cutterheads, the rectangular beam or cant is supported by planar guides which contact its newly formed surface areas. If desired, rip saws may be employed to cut the beam longitudinally prior to its being discharged from apparatus 10 by a set of outfeed rollers.

The invention may be embodied in other specific forms without departing from the spirit or central characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. Apparatus for producing lumber for a log comprising:

a. a frame assembly having a log infeed end and a lumber outfeed end with a linear travel path therebetween to be traversed by the longitudinal center axis of a log being formed into lumber, b. a pair of opposed top and bottom rotary particle-forming cutter heads adapted to form parallel planar top and bottom surfaces on a log, said cutter heads having a common direction of rotation thereby exerting a lateral force on the log directed toward one lateral side of the travel path, c. an infeed kerf cutter arranged to form a bottom longitudinal kerf in the portion of the log to be cut away by said bottom cutter head, d. a bottom guide rail adjacent said kerf cutter and adapted to slide in said kerf, e. a pair of opposed side rotary particle-forming cutter heads located between said kerf cutter and said top and bottom cutter heads and adapted to form parallel planar surfaces along the lateral sides of the log whereby said pairs of cutter heads can collectively form a cant of rectangular cross-section, said side cutter heads having a common direction of rotation, f. side guide means located on said one lateral side of the travel path so as to resist said lateral force component by contacting the respective lateral surface of the cant at a location adjacent the top and bottom cutter heads, g. bottom guide means located on the outfeed side of said bottom cutter head and adjacent thereto for contacting the bottom surface of the cant, h. first adjusting means on the frame assembly for moving said kerf cutter, bottom rail, bottom guide means and bottom cutter head vertically as a first unit selected amounts, and for simultaneously moving a second unit comprising said top cutter head, oppositely to the movement of said first unit at the same vertical distance from said travel path as the first unit, i. second adjusting means on the frame assembly for horizontally moving as a third unit said side guide means and the respective side cutter head, and for simultaneously moving a fourth unit comprising the other side cutter head oppositely to the movement of said third unit the same distance from said travel path as the third unit, and j. infeed and outfeed conveyor means carried by said frame assembly for moving a log along said travel path.

2. Apparatus according to claim 1 in which said outfeed conveyor means comprises opposed upper and lower outfeed rollers, the upper roller comprising part of said first unit and the lower outfeed roller comprising part of said second unit whereby said first adjusting means maintains said rollers equidistant from said travel path.

3. Apparatus according to claim 1 in which said infeed conveyor means includes opposed upper and lower infeed rollers, and means for adjusting the spacing apart of said rollers to accommodate various log diameters and for maintaining said infeed rollers equidistant from said travel path.

4. Apparatus according to claim 1 in which saw means are adjustably carried by said frame assembly to be selectively moved into engagement with the lead end of a formed cant between said bottom guide means and said outfeed conveyor means.

5. Apparatus according to claim 1 in which said fourth unit includes a respective side guide means adjacent the outfeed side of the side cutter head on the lateral side opposite from the first mentioned side guide means.

6. Apparatus according to claim 1 in which said second unit includes a top guide means located adjacent the outfeed side of the upper cutter head for guiding the top planar surface of the cant.

7. Apparatus according to claim 1 in which said common direction of the side cutter heads is such that the latter are moving downwardly in their log cutting zone.

8. Apparatus according to claim 1 in which said first adjusting means comprises a first control device and a first linkage system interconnecting said first and second units with said first control device whereby selected movement of the latter responsively moves said first and second units simultaneously like amounts relative to said travel path.

9. Apparatus according to claim 7 in which said second adjusting means comprises a second control device and a second linkage system interconnecting said third and fourth units simultaneously like amounts relative to said travel path, said first and second adjusting means being independently adjustable by movement of said first and second control devices.

10. Apparatus according to claim 1 in which each of said four cutter heads is carried by a respective slide member slidably mounted on a guide rigidly mounted on said frame assembly.

11. Apparatus according to claim 10 in which said bottom guide means is mounted on the respective slide member for said bottom cutter head.

12. Apparatus according to claim 10 in which said side guide means is mounted on the respective slide members for the side cutter head located on the same lateral side of the travel path as the side guide means.

13. Apparatus for producing rough cut lumber from a log comprising, a frame assembly having a log infeed end and a rough cut lumber outfeed end with a linear travel path therebetween to be traversed by the longitudinal center axis of a log being formed into lumber, a bottom guide-kerf cutting saw beneath said path and a pair of coplanar side guide-kerf cutting saws at opposite sides of said path with all three of said saws arranged coplanar to said path and arranged to cut guide-kerfs along the bottom and opposite horizontal sides of a log conveyed along said path, bottom and side infeed guide rails adjacent respective of said guide-kerf saws and adapted to slide in the kerfs cut thereby, a pair of opposed upper and lower particle-forming cutter heads and a pair of opposed side particle-forming cutter heads adjacent said infeed rails and adapted to shape said log into a planar-surface cant of rectangular cross-section as the log is conveyed lengthwise, a bottom guide adjacent the outfeed side of the lower cutter head and adapted to guide the bottom planar surface of such a cant, first adjusting means on the frame assembly for moving said bottom saw, bottom rail, lower cutter-head and bottom guide surface vertically as a first unit selected amounted and for moving a second unit, including said upper cutter head, oppositvely to the movement of said first unit the same distance from said travel path, second adjusting means on the frame assembly for horizontally moving as a third unit the saw, guide rail, and cutter head at one side in selected horizontal amounts and for moving a fourth unit comprising the saw, guide rail, and cutter head at the outer side oppositely to the movement of said third unit the same distance from said travel path, whereby said travel path is always located midway between said first and second units and midway between said third and fourth units, and infeed and outfeed conveyor means carried by said front assembly for moving a log with its longitudinal center axis traversing said travel path.

* * * * *